US009622592B2

(12) United States Patent
Barron et al.

(10) Patent No.: US 9,622,592 B2
(45) Date of Patent: Apr. 18, 2017

(54) CHILD SEAT INSERTS AND METHODS OF MANUFACTURE

(75) Inventors: Traci J. Barron, Saint John, IN (US); Marisa A. Williams, Berwyn, IL (US)

(73) Assignee: KOLCRAFT ENTERPRISES, INC., Chicago, IL (US)

( * ) Notice: Subject to any disclaimer, the term of this patent is extended or adjusted under 35 U.S.C. 154(b) by 1930 days.

(21) Appl. No.: 12/769,417

(22) Filed: Apr. 28, 2010

(65) Prior Publication Data

US 2011/0148159 A1 Jun. 23, 2011

Related U.S. Application Data

(60) Provisional application No. 61/288,671, filed on Dec. 21, 2009, provisional application No. 61/289,799, filed on Dec. 23, 2009.

(51) Int. Cl.

| | |
|---|---|
| ***A47D 1/10*** | (2006.01) |
| ***A47D 1/02*** | (2006.01) |
| ***A47D 7/04*** | (2006.01) |

(52) U.S. Cl.

CPC ..... *A47D 1/10* (2013.01); *A47D 1/02* (2013.01); *A47D 7/04* (2013.01); *Y10T 29/481* (2015.01)

(58) Field of Classification Search

CPC ... A47D 1/10; A47D 1/02; A47D 7/04; Y10T 29/481

USPC ..... 5/93.1, 93.2, 94, 95, 97, 98.1, 98.3, 99.1

See application file for complete search history.

(56) References Cited

U.S. PATENT DOCUMENTS

| | | | | |
|---|---|---|---|---|
| 1,204,416 | A * | 11/1916 | Doser | 5/94 |
| 2,277,406 | A | 3/1942 | Mahr | |
| 2,467,890 | A * | 4/1949 | Harvey | 5/122 |
| 2,488,225 | A * | 11/1949 | Mover | 297/8 |
| 2,990,007 | A | 6/1961 | Kessler | |
| 3,146,028 | A | 8/1964 | Grosfillex | |
| 3,311,934 | A * | 4/1967 | Goldberg | 5/102 |

(Continued)

FOREIGN PATENT DOCUMENTS

| | | | |
|---|---|---|---|
| CN | 2190912 | Y | 3/1995 |
| CN | 1274559 | A | 11/2000 |
| CN | 101297726 | A | 11/2008 |

OTHER PUBLICATIONS

The State Intellectual Property Office of China, "First Office Action," issued in connection with Application No. 201010599288.0, Sep. 12, 2013, 9 pages.

(Continued)

*Primary Examiner* — David E Sosnowski

*Assistant Examiner* — David R Hare

(74) *Attorney, Agent, or Firm* — Hanley, Flight and Zimmerman, LLC

(57) ABSTRACT

Seat inserts and methods of manufacture are described. An example seat insert includes a fastener to removably couple the seat insert to a bassinet or playard. The example seat include also includes a first base panel having a first length, a first end and a second end and a second base panel having a second length, a first end and a second end. The second end of the first base panel is coupled to the first end of the second base panel. In addition, the first length is longer than the second length so that the first base panel is positioned at a first incline and the second base panel is positioned at a second incline different than the first incline to cause a child occupant to assume a semi-upright position.

29 Claims, 15 Drawing Sheets

(56) References Cited

U.S. PATENT DOCUMENTS

| | | | | |
|---|---|---|---|---|
| 4,426,113 | A | 1/1984 | Schutz | |
| 4,602,816 | A * | 7/1986 | Chandler | 296/63 |
| 5,096,260 | A * | 3/1992 | Hagerstrom | 297/256.17 |
| 5,161,273 | A | 11/1992 | Deck | |
| D340,140 | S | 10/1993 | Cunningham et al. | |
| 5,269,587 | A * | 12/1993 | Cunningham et al. | 297/42 |
| D347,328 | S | 5/1994 | Efthimiou | |
| 5,339,470 | A | 8/1994 | Shamie | |
| D353,493 | S | 12/1994 | Schwartzkopf et al. | |
| 5,409,411 | A | 4/1995 | Schrieber | |
| 5,553,336 | A * | 9/1996 | Mariol | 5/93.1 |
| 5,778,465 | A * | 7/1998 | Myers | 5/99.1 |
| 5,845,349 | A | 12/1998 | Tharalson | |
| 5,867,580 | A | 2/1999 | Anderson | |
| 5,991,944 | A | 11/1999 | Yang | |
| 6,026,525 | A * | 2/2000 | Davis | 5/99.1 |
| 6,058,528 | A | 5/2000 | Yang | |
| 6,192,535 | B1 * | 2/2001 | Warner et al. | 5/93.1 |
| 6,233,759 | B1 | 5/2001 | Warner, Jr. et al. | |
| 6,421,856 | B1 | 7/2002 | Furnback | |
| 6,430,762 | B1 | 8/2002 | Cheng | |
| D467,093 | S | 12/2002 | Brophy | |
| 6,526,608 | B1 | 3/2003 | Hsia | |
| 6,539,563 | B1 * | 4/2003 | Hsia | 5/93.2 |
| 6,634,038 | B2 | 10/2003 | Hsia | |
| 6,708,356 | B1 * | 3/2004 | LaValle | 5/655 |
| 6,735,796 | B2 | 5/2004 | Warner, Jr. et al. | |
| 6,915,536 | B2 | 7/2005 | Chen | |
| 6,961,968 | B2 | 11/2005 | Clapper et al. | |
| 7,003,821 | B2 * | 2/2006 | DeHart et al. | 5/93.1 |
| 7,017,203 | B2 | 3/2006 | Chen | |
| 7,055,191 | B1 | 6/2006 | Chen | |
| 7,059,000 | B2 | 6/2006 | Verbovszky | |
| 7,111,339 | B2 | 9/2006 | Chen | |
| D535,506 | S | 1/2007 | Wilson | |
| 7,228,575 | B2 | 6/2007 | Chen | |
| 7,263,729 | B2 | 9/2007 | Paesang et al. | |
| 7,418,745 | B2 | 9/2008 | Paesang et al. | |
| 7,458,114 | B2 | 12/2008 | Troutman | |
| 7,543,342 | B2 | 6/2009 | Zhao et al. | |
| 7,568,242 | B2 | 8/2009 | Troutman | |
| 8,028,358 | B2 | 10/2011 | Fiore, Jr. | |
| 8,201,291 | B2 | 6/2012 | Burns et al. | |
| 8,424,138 | B1 | 4/2013 | Pinnell | |
| 2002/0092094 | A1 | 7/2002 | Welsh, Jr. | |
| 2003/0046761 | A1 | 3/2003 | Hsia | |
| 2003/0070230 | A1 | 4/2003 | Hsia | |
| 2003/0177575 | A1 | 9/2003 | Cheng et al. | |
| 2005/0278857 | A1 | 12/2005 | Fairchild et al. | |
| 2006/0207023 | A1 | 9/2006 | DeHart et al. | |
| 2006/0218725 | A1 | 10/2006 | Carpenter et al. | |
| 2006/0253978 | A1 | 11/2006 | Paesang et al. | |
| 2008/0271243 | A1 * | 11/2008 | Burkholder et al. | 5/93.2 |
| 2009/0077738 | A1 | 3/2009 | Burns et al. | |
| 2009/0077739 | A1 * | 3/2009 | Mendes et al. | 5/93.1 |
| 2009/0077740 | A1 | 3/2009 | Jackson et al. | |
| 2010/0255919 | A1 | 10/2010 | Kelly et al. | |
| 2011/0148159 | A1 | 6/2011 | Barron et al. | |
| 2011/0197358 | A1 | 8/2011 | Bu et al. | |

OTHER PUBLICATIONS

The State Intellectual Property Office of China, "Search Report," issued in connection with Application No. 201010599288.0, Sep. 12, 2013, 2 pages.

United States Patent and Trademark Office, "Non-Final Office Action," issued in connection with U.S. Appl. No. 13/279,223, May 8, 2013, 13 pages.

United States Patent and Trademark Office, "Non-Final Office Action," issued in connection with U.S. Appl. No. 13/279,223, Jan. 15, 2013, 25 pages.

United States Patent and Trademark Office, "Applicant-Initiated Interview Summary," issued in connection with U.S. Appl. No. 13/279,223, Aug. 6, 2013, 3 pages.

"Examiner Interview Summary," submitted in connection with U.S. Appl. No. 13/279,223, Jul. 30, 2013, 1 page.

* cited by examiner

CHILD SEAT INSERTS AND METHODS OF MANUFACTURE

RELATED APPLICATIONS

This patent claims the benefit of U.S. Provisional Patent Application Ser. No. 61/288,671, entitled "Bassinet Seat Inserts and Methods of Assembly," which was filed on Dec. 21, 2009, and U.S. Provisional Patent Application Ser. No. 61/289,799, entitled "Bassinet Seat Inserts and Methods of Assembly," which was filed on Dec. 23, 2009, both of which are incorporated herein by reference in their entireties.

FIELD OF THE DISCLOSURE

This disclosure relates generally to child care products, and, more particularly, to child seat inserts and methods of manufacturing the same.

BACKGROUND

Stand alone bassinets and bassinets that are coupled to playards are known in the art. Typically, a bassinet includes a flat, horizontal sleeping surface for a child.

DETAILED DESCRIPTION

Figure 1:
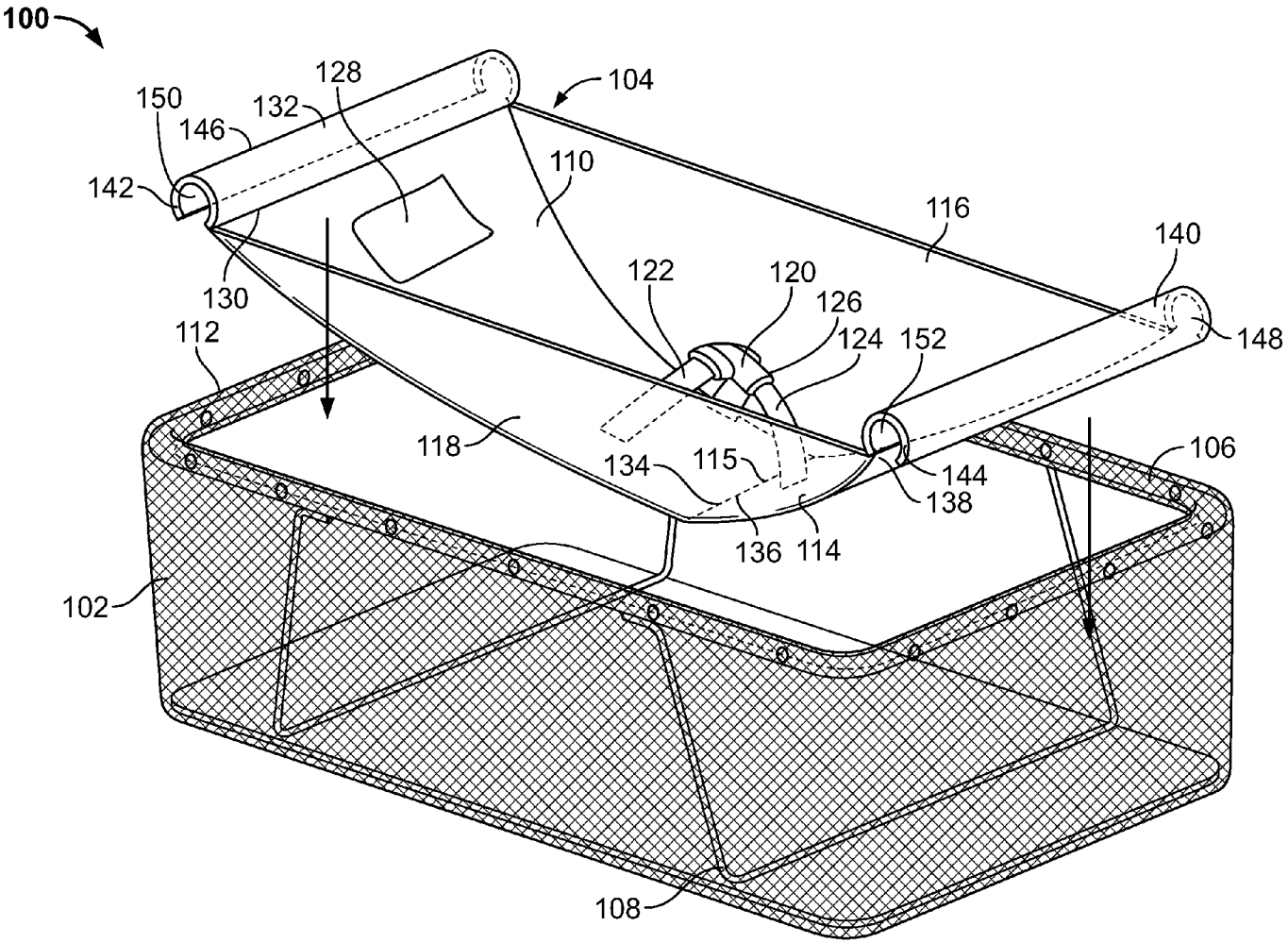
FIG. 1 is an isometric view of an example bassinet seat insert assembly.

FIG. 1 shows example bassinet and seat insert assembly 100 that includes a bassinet 102 and a seat insert 104. The seat insert 104 is structured to be removably coupled to the bassinet 102 such as, for example, by attaching the seat insert 104 to one or more top rails or upper frame 106 of a bassinet frame 108.

The example seat insert 104 includes a base 110. The base 110 has a seat back or first base panel 112 and a seat pan or second base panel 114 joined and positioned at an obtuse angle when viewed in cross-section and mounted to the bassinet 102. In some examples, the first base panel 112 and second base panel 114 are integrally formed. In addition, "panel" is meant to include single pieces of material or multiple pieces coupled together. In other examples, as detailed below, the base panels 112, 114 are made of soft goods such as fabric portions that are sewn together at a seam 115. As shown in FIG. 1, the first base panel 112 and second base panel 114 are disposed at opposed, intersecting inclined positions. The first base panel 112 is longer than the second base panel 114 so that when an infant/child is placed in the bassinet seat insert 104, the infant is seated or lying in an inclined (i.e., semi-upright) position, with the child's bottom near or at the lowest portion of the seat insert 104. That is, the seam 115 is closer to the foot end of the seat insert 104 to allow the child to sit in an upright or semi-upright position. In some examples, the panels 112, 114 engage at a point approximately 9.0-9.5 inches (22.86-24.13 centimeters) below the tops of the panels 112, 114 (vertical depth). The degree of incline is dependent on the relative lengths of the base panels 112, 114 with respect to each other.

In some examples, such as those described above, the base panels 112, 114 are permanently fixed to one another and, therefore, the seam 115 is in a fixed location. However, in other examples the base panels 112, 114 may be movable with respect to one another. That is, the location at which the first base panel 112 is joined to the second base panel 114 may be adjustable, or at least the relative lengths of the base panels 112, 114 may be adjusted. Such arrangements make the angle of recline of an infant adjustable. In other examples, the first base panel 112 and the second base panel 114 are fixed with respect to one another, and the angle of recline is adjustable at a top of the first base panel 112. In such example, the first base panel may include snaps or other releasable fasteners near the top of the first base panel 112 that can be fastened or unfastened to change the effective length of the first base panel to change the angle or recline. For example, if such fasteners are released, the first base panel 112 drops down (i.e., becomes longer) and has a lower angle of recline.

An example manner of providing such adjustability is to join the panels 112, 114 with releasable zippers or other mechanical fasteners positioned at different locations on the panels. In some examples, the base panels 112, 114 may be adjustable with respect to one another via straps, snaps, loop and hook fasteners or other fasteners coupled to, for example, rear sides of the base panels 112, 114. For example, the first base panel 112 may include a plurality of male snap connectors, and the second base panel 114 may include a plurality of female snap connectors. To lower the angle of inclination of the first base panel 112, the male connectors may be coupled to female connectors on the second base panel 114 that are located closer to the foot end of the second panel 114. To increase the angle of inclination of the first base panel 112, the male connectors may be coupled to female connectors on the second base panel 114 that are located closer to the seam 115. In any of these examples, the panels 112, 114 may be permanently joined to one another or integrally formed so that these fasteners are used to adjust a degree of folding or overlapping between the panels 112, 114. Alternatively, the fasteners may be joined to the panels 112, 114 and the panels 112, 114 may not be permanently attached. A back-up (e.g., secondary) fastener such as shock cords, ties, etc. may be used for additional safety.

In the example of FIG. 1, the first base panel 112 forms a back support to support an infant, baby or child's head and back. The second base panel 112 forms a leg support to support an infant, baby or child's legs. In some examples, the second base panel 112 includes openings for the infant/child's legs. Also, in some examples, the base panels 112, 114 include insertable stiffening structures such as, for example, a back board or floorboard to provide rigidity to the seat insert 104.

The example seat insert 104 of FIG. 1 also includes a first side panel 116 and a second side panel 118. In the illustrated example, the side panels 116, 118 are disposed on opposite sides of the base 110 and run substantially parallel to each other. In other examples, the side panels 116, 118 run at angles with respect to each other and form a v-shaped profile or other profile. The side panels 116, 118 may be a solid material or formed with meshing or other ventilation structure. In some examples, the side panels 116, 18 are integrally formed with the base 110. As detailed below, the side panels 116, 118 may be soft goods that are sewn or otherwise mechanically and/or chemically coupled to the base panels 112, 114.

In the example of FIG. 1, the base panels 112, 114 and side panels 116, 118 are made of a soft goods material and/or flexible support liners such as, for example, tailored soft goods, a fabric, flexible plastic, a mesh, or any other flexible and breathable material or combination thereof. The panels 112, 114, 116, 118 are washable and may easily be rolled, folded, crumpled or otherwise compressed for transportation and/or storage. In some examples, there are stiffening board or molded inserts (e.g., a masonite board) that inserted in the base panels 112, 114 to provide structure and support. In some examples, such boards are removably inserted. Removably inserted boards may be removed prior to washing or storage.

The example seat insert 104 of FIG. 1 includes a harness 120. The example harness 120 is a three point-harness that includes one or more waist straps 122 and a crotch strap 124, which are releasably connected via a buckle 126. In other examples, the harness 120 includes shoulder straps. In some such examples, the harness is a five-point harness or any other suitable restraint structure.

In the illustrated example, a pillow 128 is releasably coupled to the first back panel 112 of the seat insert 104. The pillow 128 is removably coupled to the first back panel 112 via Velcro® strips or straps. However, any other suitable fastener may be used. In other examples, the pillow 128 is permanently attached to the seat insert 104. Furthermore, in some examples, the pillow 128 is adjustably coupled to the first back panel 112. For example, the pillow 128 may include one portion of snap or loop and hook fasteners (or any other suitable fastener), and the first base panel 112 may include a plurality of complementary fasteners so that the pillow 128 could be removably coupled to the first base panel 112 at one or more positions along the length of the first base panel 112. In addition, the pillow 128 may be coupled to one or more positions using one or more of the example approaches described in U.S. patent application Ser. No. 12/405,010, which was filed on Mar. 16, 2009, published as U.S. Patent Publication No. 2009/0235964 and is titled, "Child Caretaking Structures with Adjustable Canopies and/or Headrests" and is hereby incorporated by reference in its entirety.

Figure 2:
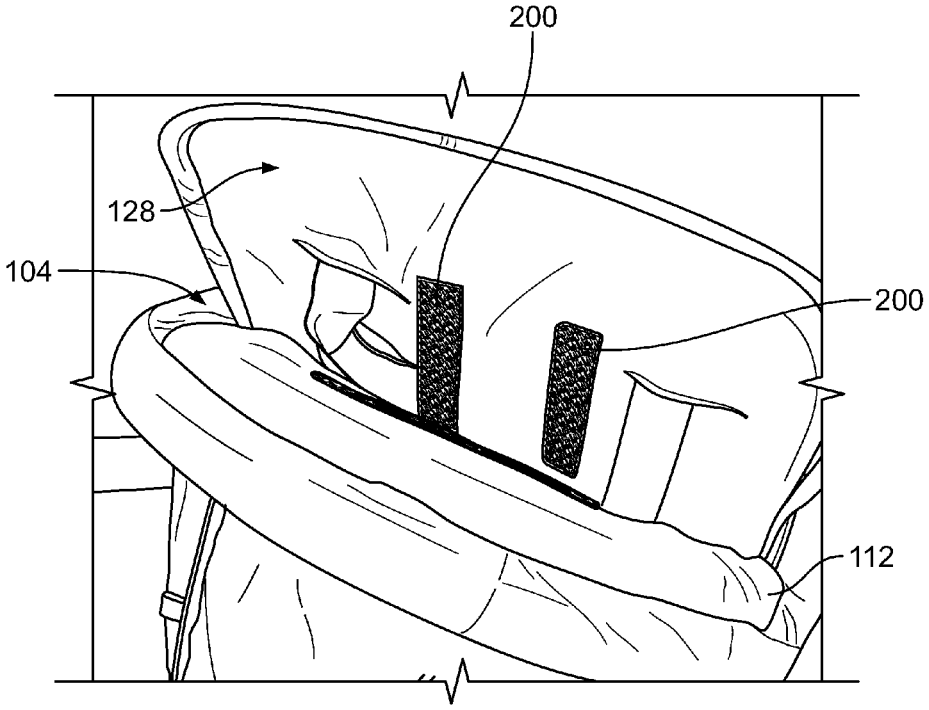
FIG. 2 is a rear perspective view of the example pillow of FIG. 1 showing the pillow in a raised/extended position.
Figure 3:
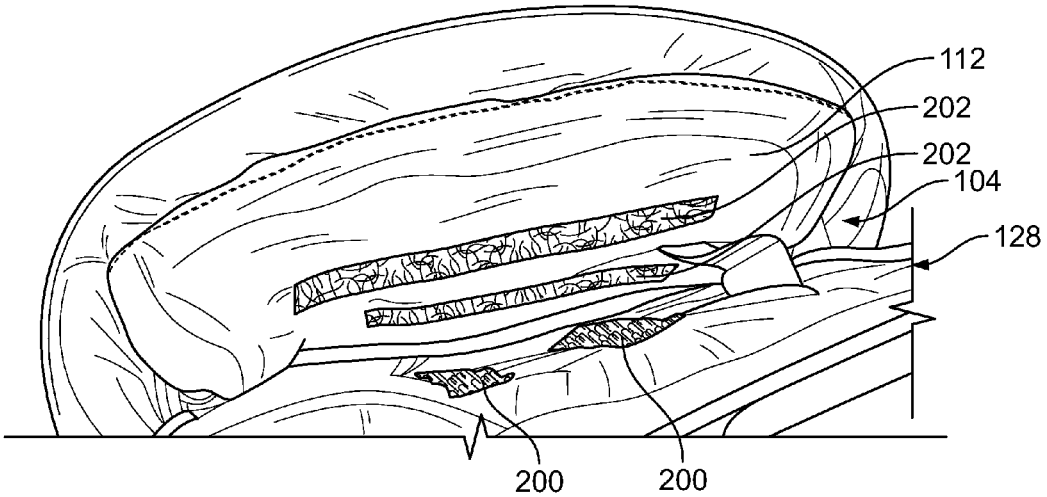
FIG. 3 is a front perspective view of the example bassinet seat insert and the example pillow of FIG. 1 pulled forward.

An example arrangement of a pillow that is adjustable relative to a back support is shown in FIGS. 2 and 3. In FIG. 2, a rear side of the pillow 128 is shown pulled away from the first base panel 112 of the seat insert 104. In FIG. 3, a front face of the first base panel 112 is shown with the pillow pulled forward. As described above, the rear side of the pillow 128 includes pillow fasteners 200 which, in the illustrated example, are Velcro® strips. In this example, the pillow fasteners 200 are generally vertically oriented (e.g, in parallel alignment with a longitudinal axis of the seat) and are substantially aligned in parallel relationship to one another. In other examples, the pillow fasteners 200 are arranged substantially horizontally, or in any other orientation, and each of the plurality pillow fasteners 200 may be aligned differently than other ones of the pillow fasteners 200. In the example of FIGS. 2 and 3, the front face of the first base panel 112 includes one or more base panel fasteners 202. The base panel fasteners 202 are implemented by Velcro® strips 202 (see FIG. 3). The base panel fasteners 202 on the first base panel 112 of FIG. 3 are arranged substantially horizontally and parallel with respect to one another (e.g., substantially transverse to a longitudinal axis of the seat). However, the base panel fasteners 202 may be arranged, in alternative examples, substantially vertically, diagonally or in any other orientation including, but not limited to, in the same orientation as the pillow fasteners 200. Additionally or alternatively, and each of the base panel fasteners 202 may be aligned differently than other ones of the base panel fasteners 202.

The mating pillow and base panel fasteners 200, 202 of the illustrated example allow the pillow 128 to be coupled to the first base panel 112 at a range of incremental discrete positions/heights between the uppermost position and the lowermost position. Thus, the pillow 128 is adjustable over a substantially continuous range of positions. The highest point of the range occurs when the lowest portion of the pillow fasteners 200 on the rear of the pillow 128 is coupled to the highest portion of the base panel fasteners 202 on the front face of the first base panel 112. The lowest point of the range occurs when the highest portion of the pillow fasteners 200 is coupled to the lowest portions of the base panel fasteners 202. Furthermore, in some examples, the pillow 202 is coupled to one or more of the panels 112, 114, 116, 118 or elsewhere to the seat insert 104 via a second fastener (which may or may not be removable) to prevent the pillow 128 from being inadvertently fully removed from the seat insert 104. In such examples, the pillow 128 may be coupled to one or more of the panels 112, 114, 116, 118 or elsewhere to the seat insert 104 via any suitable secondary fastener such as, for example, a tether (not shown), which may be made of plastic, fabric or any other suitable material.

To adjust the position of the pillow 128, the user applies a force in an upward direction, a forward direction, a downward direction or any combination thereof sufficient to overcome the frictional binding force of the pillow and base panel fasteners 200, 202. After this binding force has been overcome, the user may align the pillow 128 with the first base panel 112 at any desired height within the range of possible positions. When the pillow 128 is positioned at the desired height, the user may apply a force to the front of the pillow 128 in the direction of the first base panel 112 to engage the pillow and base panel fasteners 200, 202 and secure the pillow 128 at the corresponding position/height. The binding force of the pillow and base panel fasteners 200, 202 holds the pillow 128 at a specific position/height relative to the first base panel 112 and, thus, relative to the seat insert 104.

Returning to FIG. 1, a first end 130 of the first base panel 112 is shown coupled to a first connector 132 via any suitable mechanical and/or chemical fastener (e.g., sewn, glued, hook and loop fasteners, etc.). A second end 134 of the first base panel 112 is coupled (integrally or via any suitable fastener(s)) to a first end 136 of the second base panel 114 (e.g., via the seam 115). A second end 138 of the second base panel 114 is coupled to a second connector 140 via any suitable mechanical and/or chemical fastener (e.g., sewn, glued, etc.). In this example the first base panel 112 and the second base panel 114 are directly coupled to the respective fasteners 132, 140. In some examples, the first base panel 112 or the second base panel 114 are coupled to respective fasteners 132, 140 via intervening pieces of material. In this example the first connector 132 and second connector 140 are substantially similar and located at opposite ends of the seat insert 104. In other examples, the connectors 132, 140 may have dissimilarities and/or be located at different positions on the insert (which may or may not be symmetrical locations). Furthermore, in some examples, the first base panel 112 may be removably coupled (e.g., via Velcro strips) to the first connector 132 and/or the second base panel 114 may be removably coupled to the second connector 140. Example fasteners to couple the base panels 112, 114 to the connectors 132, 140 are described below with respect to FIGS. 8-13.

Figure 4:
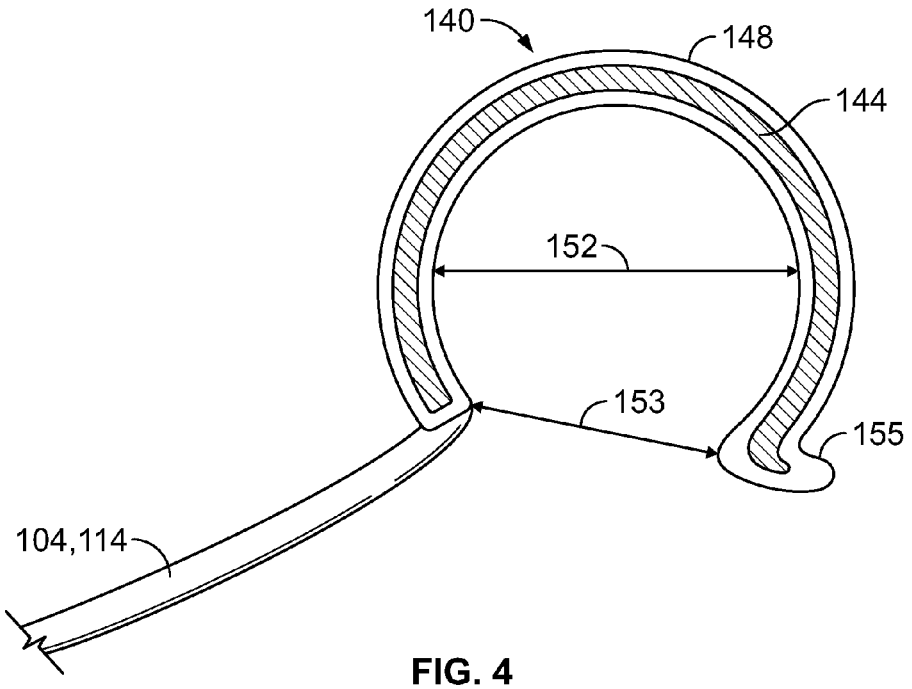
FIG. 4 a cross-sectional view of an example clip.
Figure 5:
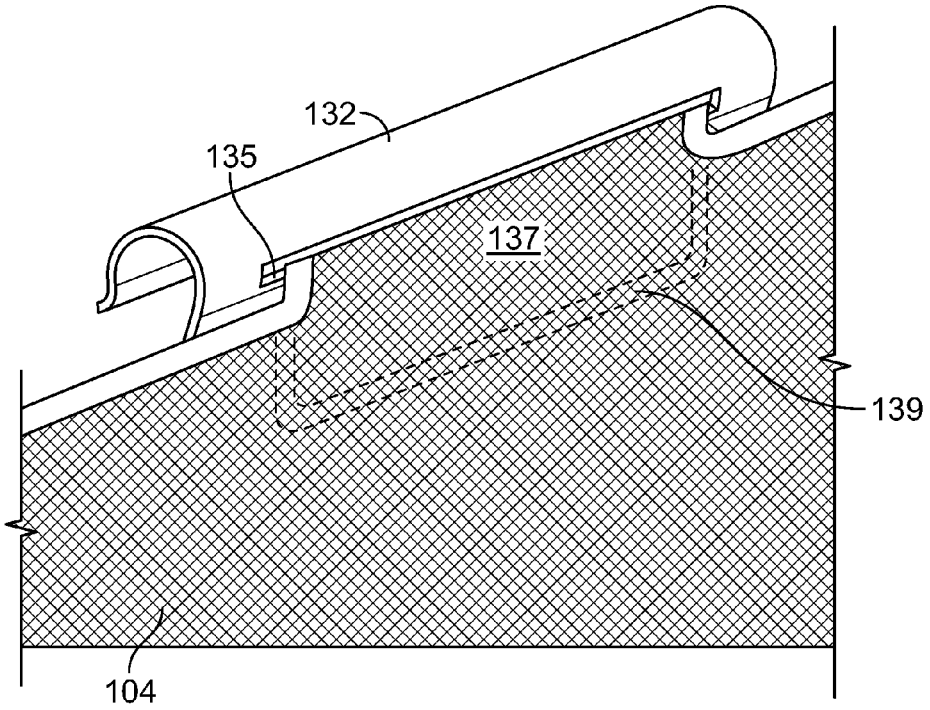
FIG. 5 is an enlarged view of an alternative example clip.

In the example of FIG. 1, the first connector 132 includes a first elongated clip 142. Likewise, the second connector 140 includes a second elongated clip 144. In the example of FIG. 1, the first and second elongated clips 142, 144 are housed in respective first and second sleeves 146, 148, as shown in cross-sectional view in FIG. 4. In this example, the sleeves 146, 148 extend substantially the entire width of the first and second base panels 112, 114 (see FIG. 1). In some examples, the sleeves 146, 148 are integrally formed with the base panels 112, 114. The sleeves 146, 148 and/or the base panels 112, 114 also may be coupled to the clips 142, 144 by mechanical fasteners (e.g., sewing, rivets, etc.) and/or chemical fasteners (e.g., glue, heat fusing, etc.). In the example shown in FIG. 5, the example clip 132 includes a slit or slot 135. A portion of the fabric of the example seat insert 104, or a strap or a fabric extension 137, is slid through the slot 135. A portion of the strap or of the fabric extension 137 that passed through the slot is sewn or otherwise mechanically fastened to the opposite side of the seat insert 104 (shown by seam 139 of FIG. 5).

In the illustrated example, the example clips 142, 144 are shown as continuous cylindrical-like pieces that have a longitudinal section omitted and/or removed to form an opening such that the clips 142, 144 have C-shaped cross-sections. In other examples, the clips 142, 144 need not be continuous and may include two spaced apart parallel side walls. The side walls may be coupled via a joining member (e.g., a semi-rigid or rigid spacer or living hinge). In the example of FIG. 1, the clips 142, 144 each form respective central channels 150, 152 that are sized to accommodate a portion of the upper frame 106 of the bassinet 102. Central portions of the channels 150, 152 are at least as wide as the width of the upper frame 106. Lower portions 153 of the channels 150, 152 are shorter than the diameter of the upper frame 106 so that the clips 142, 144 are securely couplable around the upper frame 106. The clips 142, 144 are resiliently deformable such that the lower portion 153 (i.e., the openings) of the channels 150, 152 may be stretched to fit over the upper frame 106. Though linear clips 142, 144 are shown in these figures, in other examples, the clips could be curved, oblong or otherwise shaped to follow the contours of a bassinet that has a profile of any shape.

To remove the clips 142, 144 from the top frame 106, the side walls of the clips 142, 144 are pulled outward to increase the distance across the openings of the channels 150, 152 to a length greater than the diameter of the rails of the top frame 106. This enables the clips 142, 144 to be pulled off of the top frame and removed therefrom. To facilitate mounting and dismounting of the clips 142, 144 to/from the top frame 106, the sides of the clips 142, 144 include a grip portion 155 that flares outward to provide additional surface area that may be grasped to provide greater leverage for increasing the size of the openings 153.

In some examples, the clips 142, 144 may be split into two or more clips on each side (see FIG. 6 and related discussion, below). Alternatively, the clips 142, 144 may be replaced with a smaller, centralized clip. Additionally or alternatively, there may be clips along the side panels 116, 118 along with or in place of the clips 142, 144 shown. The clips 142, 144 may be implemented by and/or include features of the clips described in U.S. Pat. No. 7,458,114, titled "Clips for Mounting Accessories to Play Yards and Methods of Operating the Same," which is hereby incorporated herein by reference in its entirety.

The seat insert 104 is not limited to use with bassinets. Instead, the clips 142, 144 may be used to secure the seat insert 104 to play yards, cribs, cradles, or other structures. Furthermore, the seat insert 104 may be secured to other structures at the same time other accessories are attached to such structures. For example, the seat insert 104 may be attached to a playard at the same time a structure, such as a bassinet, changing table, storage compartment, or other device is attached to the playard (see FIG. 7 and related discussion, below).

The example seat insert 104 of FIG. 1 is shown removably coupled to the bassinet 102 via the example clips 142, 144. In other examples, other fasteners additionally or alternatively may be used to removably couple the seat insert 104 to the bassinet 102 or other child caretaking structure. For example, the base panels 112, 114 may be coupled to sleeves that include snaps that snap around the upper frame 106. In other examples, the base panels 112, 114 may be coupled to straps that include loop and hook (i.e., Velcro®) fasteners such strap may wrap around the upper frame 106 and be removably couplable to the themselves via the hook and loop fastener. In yet other examples, the base panels 112, 114 may be coupled to straps that tie around the upper frame 106.

Other suitable removable mechanical fasteners e.g., zippers, rivets, etc.) may additionally or alternatively be used. Furthermore, in some examples, the seat insert 104 may be coupled to the soft goods of the bassinet (e.g., via Velcro strip(s), zipper(s) or snap(s)) or otherwise coupled to any portion of the bassinet or other child caretaking device.

Figure 6:
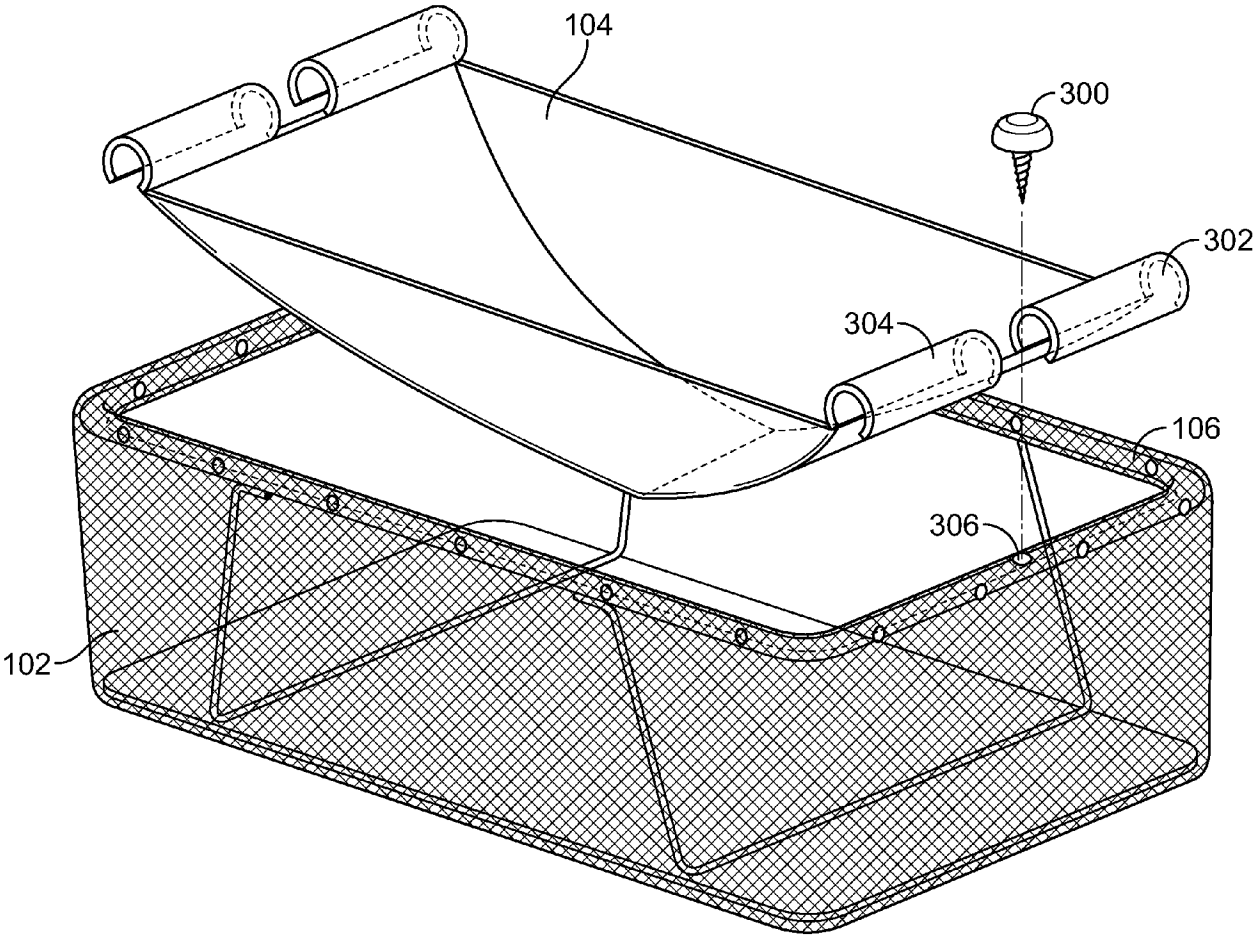
FIG. 6 is an isometric view of the example bassinet seat insert assembly with alternative example clips and an example locking mechanism.

In the example of FIG. 6, two clips 302, 304 are provided on each end of the seat insert 104. In the example of FIG. 6, a releasable locking mechanism 300 is coupled to the upper frame 106 of the bassinet 102 by, for example, screwing the locking mechanism 300 into an aperture 306 in the upper frame. The locking mechanism may alternatively be coupled to the top frame 106 by other suitable means. The locking mechanism 300 of FIG. 6 has a width that extends over at least part of at least one of the clips 302, 304 to hold the clips 302, 304 in a secured arrangement against the upper frame 106 when the locking mechanism 300 is in the locked position. The locking mechanism 300 may provide a visual indicator to the caretaker that the seat insert 104 is secured to the bassinet 102 properly. In the illustrated example, the locking mechanism 300 includes an ergonomic grip portion that facilitates manual gripping of the locking mechanism 300. In addition, the locking mechanism 300 may be incorporated into a mobile or other entertainment device. For example, the locking mechanism may form the base of a support structure to which a mobile is attached.

In addition, in some examples, there may be a strap that extends across the entire width of the seat insert 104 and couples the seat inserts 104 to the bassinet 102 or other structure. The strap may form part of a child restraint and/or may form a secondary fastener for coupling the seat insert 104 to the underlying structure for additional safety.

The orientation of the base panels 112, 114 provide an inclined sleep/resting surface for an infant occupying the seat insert 104, which elevates the child's head. The inclined surface may help ease symptoms of reflux or congestion and/or otherwise facilitate digestive and/or respiratory functions in some situations. Furthermore, the orientation of the panels 112, 114, 116, 118 and/or the inclusion of the pillow 128 and harness 120 restrict movement of the infant occupant. This is accomplished without use of a frame (e.g., without metal or plastic tubing or bars) thereby facilitating ease of use, washing and maintenance of the seat insert 104.

Figure 20:
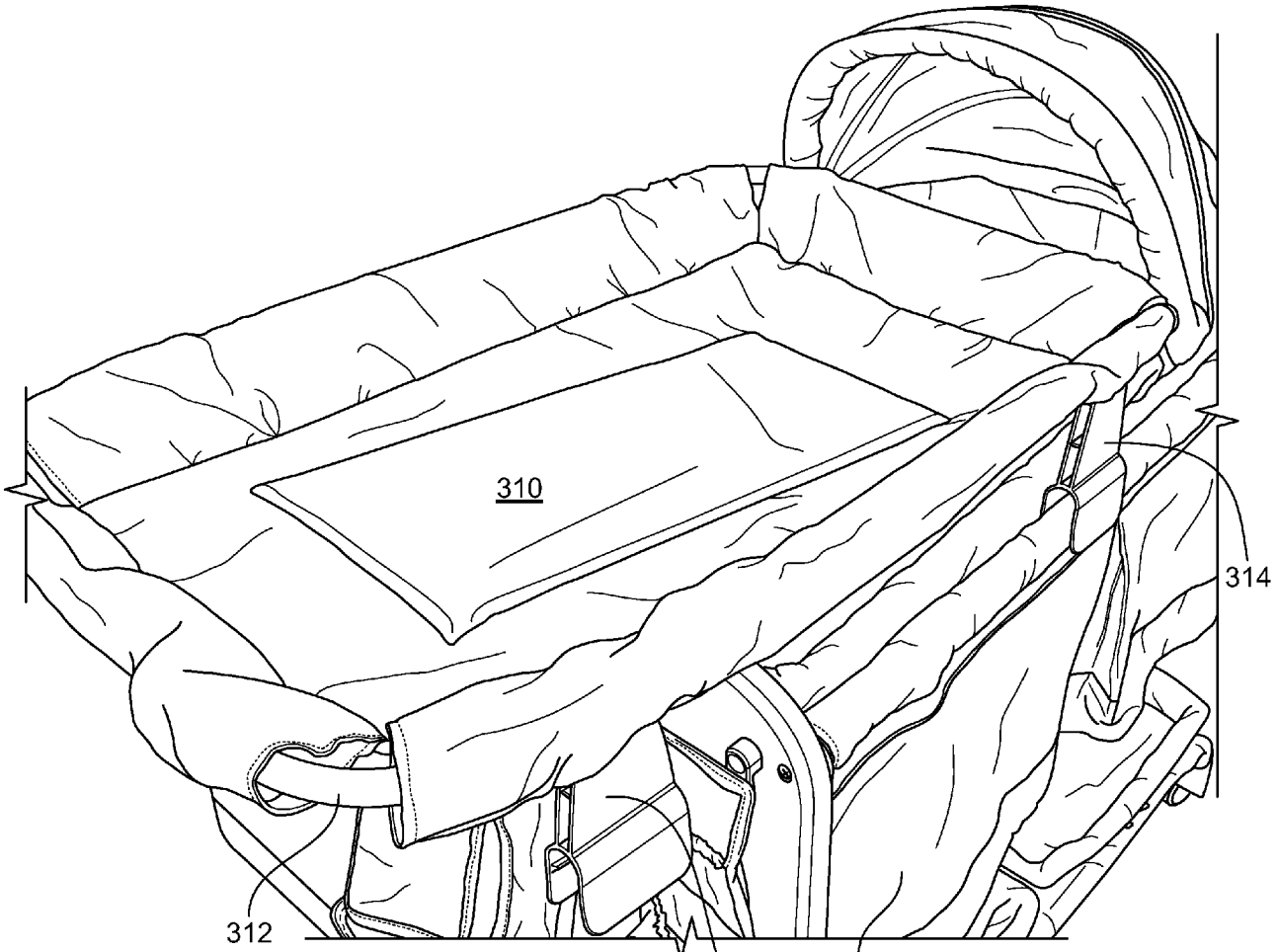
FIG. 20 is an alternative child care assembly with alternative example clips.

The examples described above show a frameless seat insert 104 that can be used with child caretaking devices to enable a child to sleep, sit, play and/or rest in a semi-upright position. In other examples, the seat insert 104 may include frame structure such as, for example, one or more rails disposed along the top perimeter of the panels 112, 114, 116, 118. In addition, downward projecting rails may be used to create the inclined relationship between the first and second base panels 112, 114. Furthermore, the clips 142, 144 may be integral with or coupled to such frame. For example, FIG. 20 shows example clips coupled to a child care-taking structure, which is discussed in more detail below.

In examples without frames, the flexibility of the panels 112, 114, 116, 118 enables the seat insert 104 to be stretched or compact to fit different openings. Therefore, a strict adherence to specific widths, opening or other parameters is not needed. However, in other examples, the dimensions of the example seat insert 104 are set to fit a defined opening when the seat insert 104 is in the deployed (i.e., not stored) position.

Figure 7:
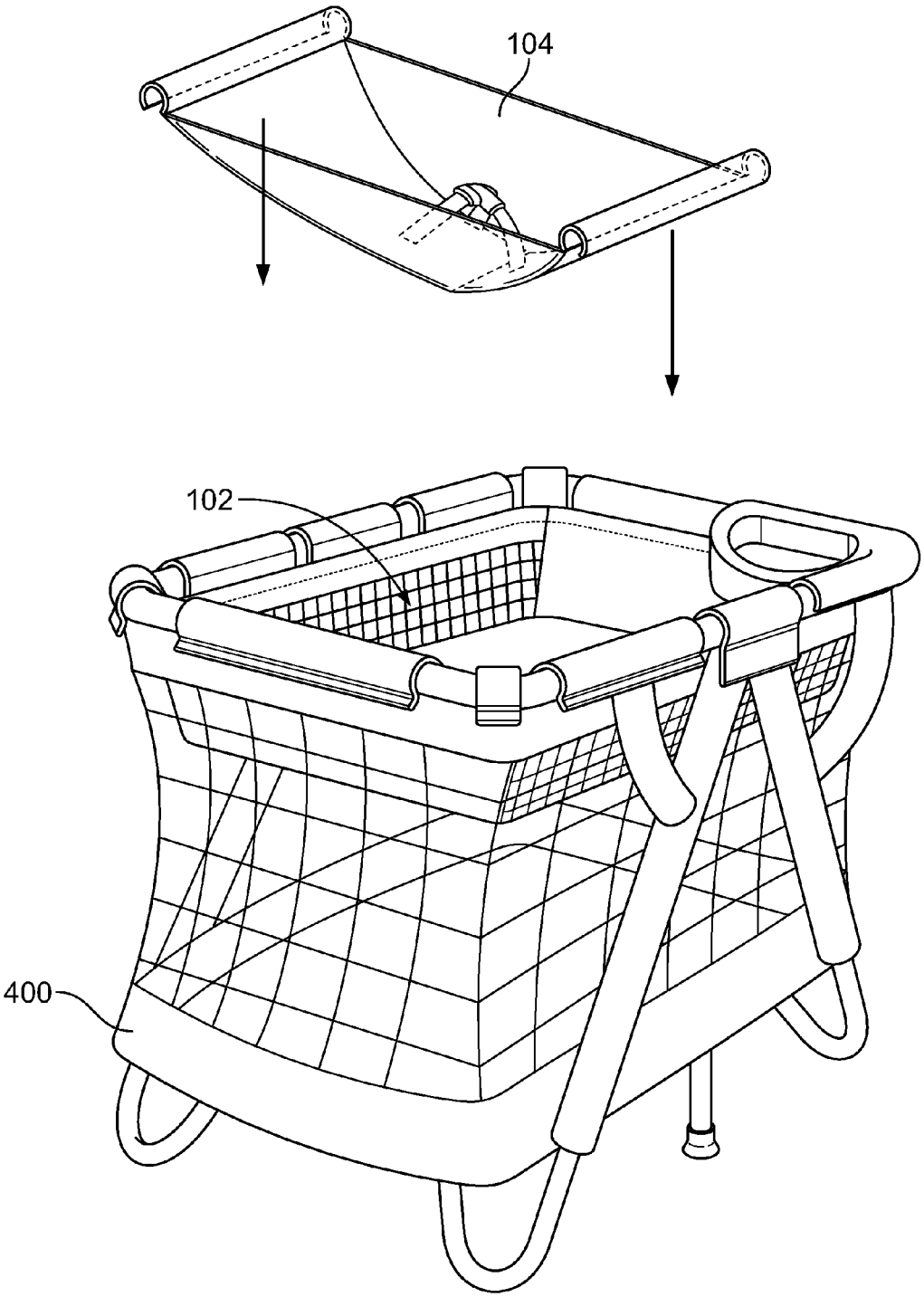
FIG. 7 is an isometric view of the example bassinet seat insert assembly of FIG. 1 with an alternative example bassinet and an example playard.

The example seat insert 104 may be combined with a bassinet and a playard 400, as shown, for instance, in FIG. 7. Alternatively, the seat insert 104 may be coupled directly to the playard 400 without the intervening bassinet in a manner similar to that described above. Example playards and/or bassinets include those described in U.S. Pat. No. 5,778,465, which is entitled "Bassinet for Attachment to a Child's Playard" and U.S. Pat. No. 5,867,850, which is entitled "Bassinet", both of which are hereby incorporated by reference in their entireties.

Figure 8:
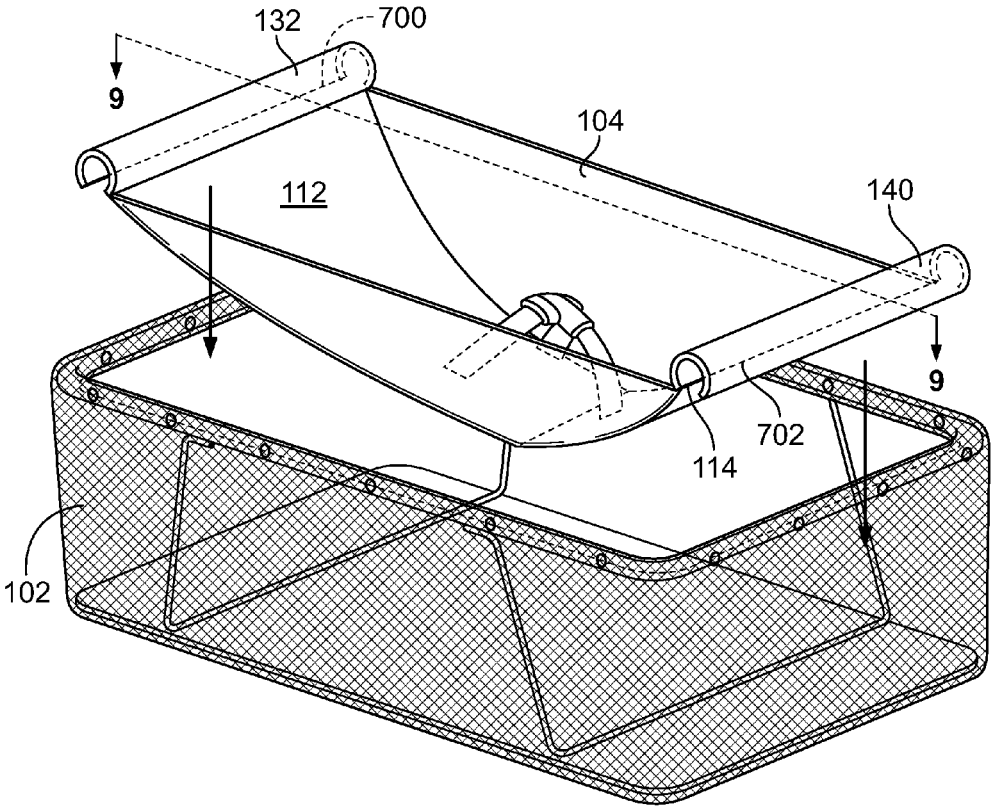
FIG. 8 is an isometric view of the example bassinet seat insert assembly of FIG. 1 shown disassembled and above the example bassinet of FIG. 1.
Figure 9:
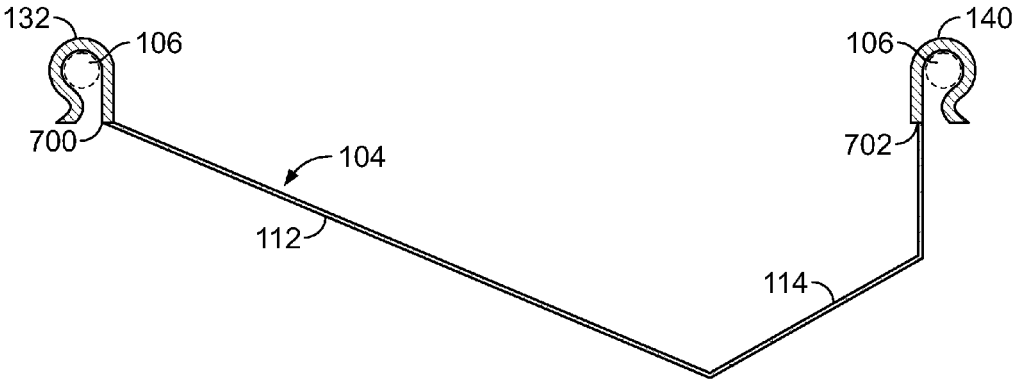
FIG. 9 is a cross-sectional view of the example bassinet seat assembly of FIG. 8 taken along line A-A of FIG. 8 shown installed around an example upper frame of the example bassinet.

As noted above, the base panels 112, 114 may be coupled to connectors 132, 140 via any suitable mechanical and/or chemical fasteners. For example, as shown in FIGS. 8 and 9, the first panel 112 is sewn and/or glued to the first connector 132 via a first end seam or bond 700. Likewise, the second panel 114 is sewn and/or glued to the second connector 140 via a second end seam or bond 702. In this example, the seams 700, 702 are shown on the inner circumference of the connectors 132, 140. However, the seams 700, 702 may additionally or alternatively be disposed on the outer circumference of the respective connectors 132, 140. Removable fasteners may be used in this configuration as well.

Figure 10:
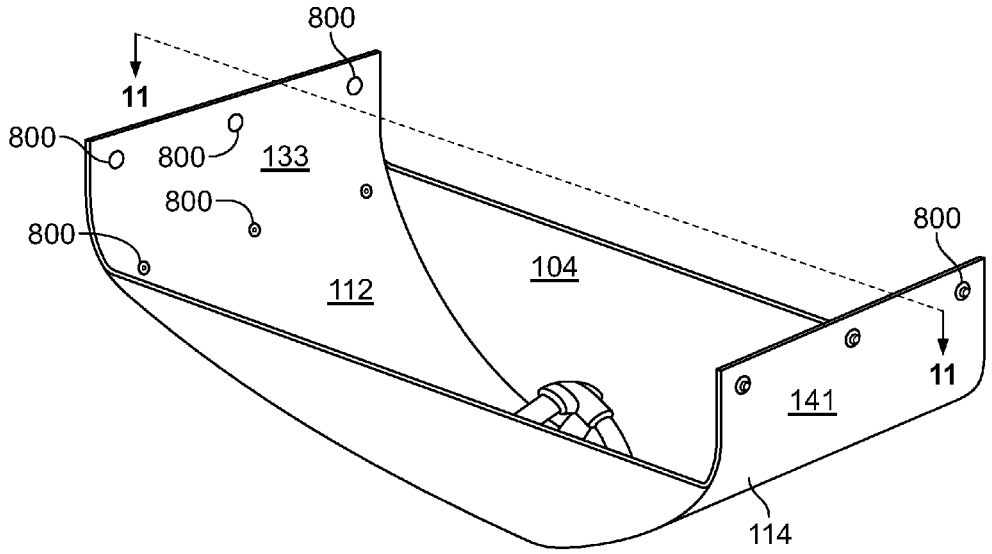
FIG. 10 is an isometric view of the example bassinet seat insert assembly of FIG. 1 with a second example clip fastener.
Figure 11:
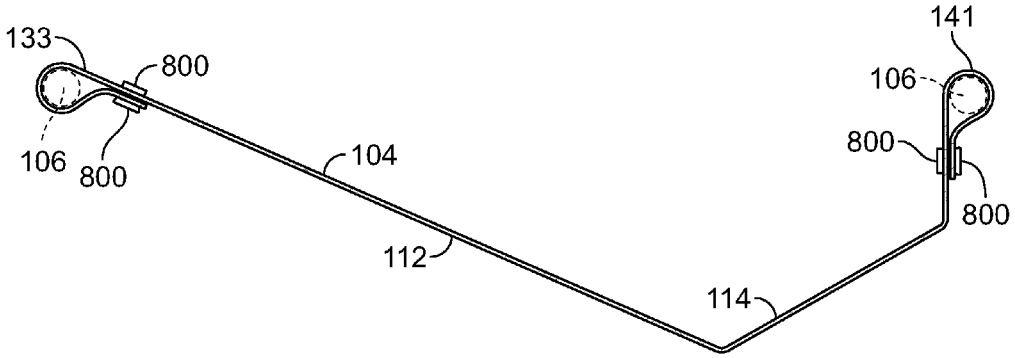
FIG. 11 is a cross-sectional view of the example bassinet seat assembly of FIG. 10 taken along line B-B of FIG. 10 shown installed around the example upper frame of the example bassinet.

FIGS. 10 and 11 show the bassinet insert seat 104 coupled to the upper frame 106 via an alternative example fastener. In this example, the first base panel 112 is provided with a first connector flap 133, and the second base panel 114 is provided with a second connector flap 141. The base panels 112, 114 and/or the connector flaps 133, 141 include one or more halves of snap-fit fasteners. The illustrated example shows a plurality of snap-fit fastener halves 800 disposed along the width of the base panels 112, 114 and/or connector flaps 133, 141. To couple the bassinet seat insert 104 to the upper frame 106 of the bassinet 102, the connector flaps 133, 141 are wrapped around the frame 106 and complementary snap-fit fastener halves 800 are aligned and removably coupled as shown in FIG. 11. Though snap-fit fasteners are described in this example, other fastener(s) including, for example, loop and hook (e.g., Velcro® fastener(s), button(s), hook(s), tie(s), or other suitable structure(s), may be used additionally or alternatively to the structures described herein.

Figure 12:
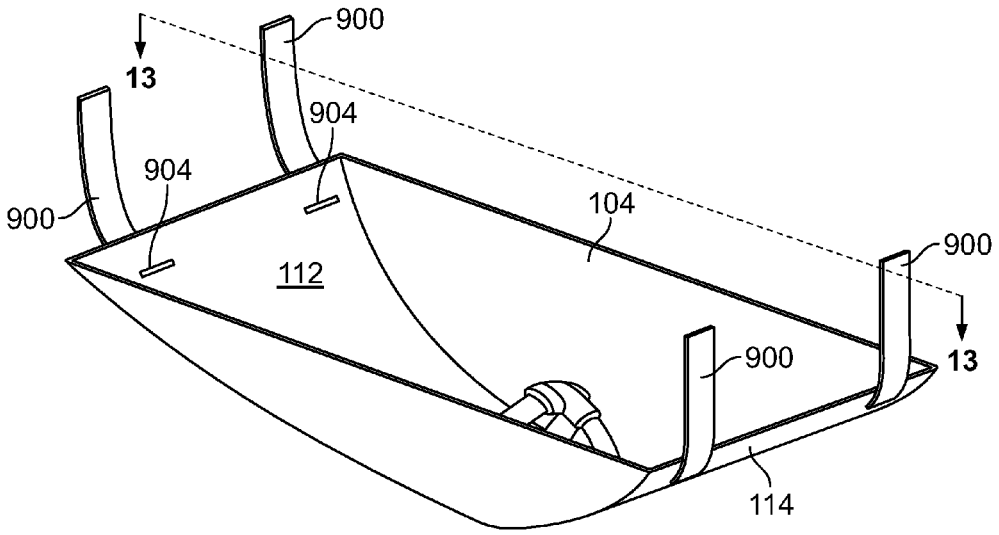
FIG. 12 is an isometric view of the example bassinet seat insert assembly of FIG. 1 with yet another example clip fastener.
Figure 13:
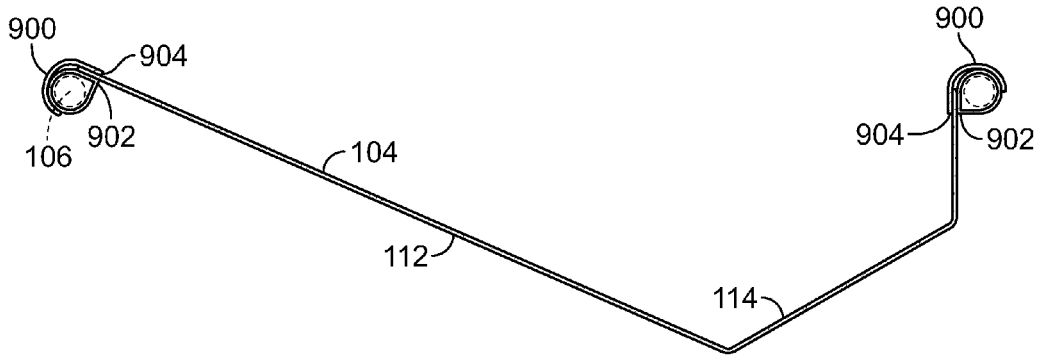
FIG. 13 is a cross-sectional view of the example bassinet seat assembly of FIG. 12 taken along line C-C of FIG. 12 shown installed around the example upper frame of an example bassinet.

FIGS. 12 and 13 show the example bassinet seat insert 104 with another alternative example fastener. In the example shown in FIGS. 12 and 13, straps (e.g., loop and fastener straps) are coupled to the base panels 112, 114 via a seam and/or bond 902. The base panels 112, 114 also include openings (e.g., slits) 904. In this example, one set of slits 904 is shown on the first base panel 112, but a plurality of slits disposed along the vertical height of the base panels 112, 114 may alternatively be used. A plurality of slits enables a user to thread the straps through different slits to change the effective length of the respective base panel 112, 114 and, with it, the angle of inclination of the respective base panel 112, 114. To couple the bassinet seat insert 104 to the upper frame 106, the straps 900 are wrapped around the frame 106, threaded through respective ones of the slits 904 and then coupled to another portion of the strap (e.g., with loop and hook fasteners, the loop side would wrap around and couple to the hook side). In the illustrated example, the straps 900 wrap around the upper frame one and a half times, though any number or fraction thereof may be used that suitably supports the weight of an infant in the bassinet seat insert 104. Though loop and hook fasteners are described in this example, other fastener(s) including, for example, snap(s), button(s), hook(s), tie(s), or other suitable structure(s), may be used additionally or alternatively to the structures described herein.

Figure 14:
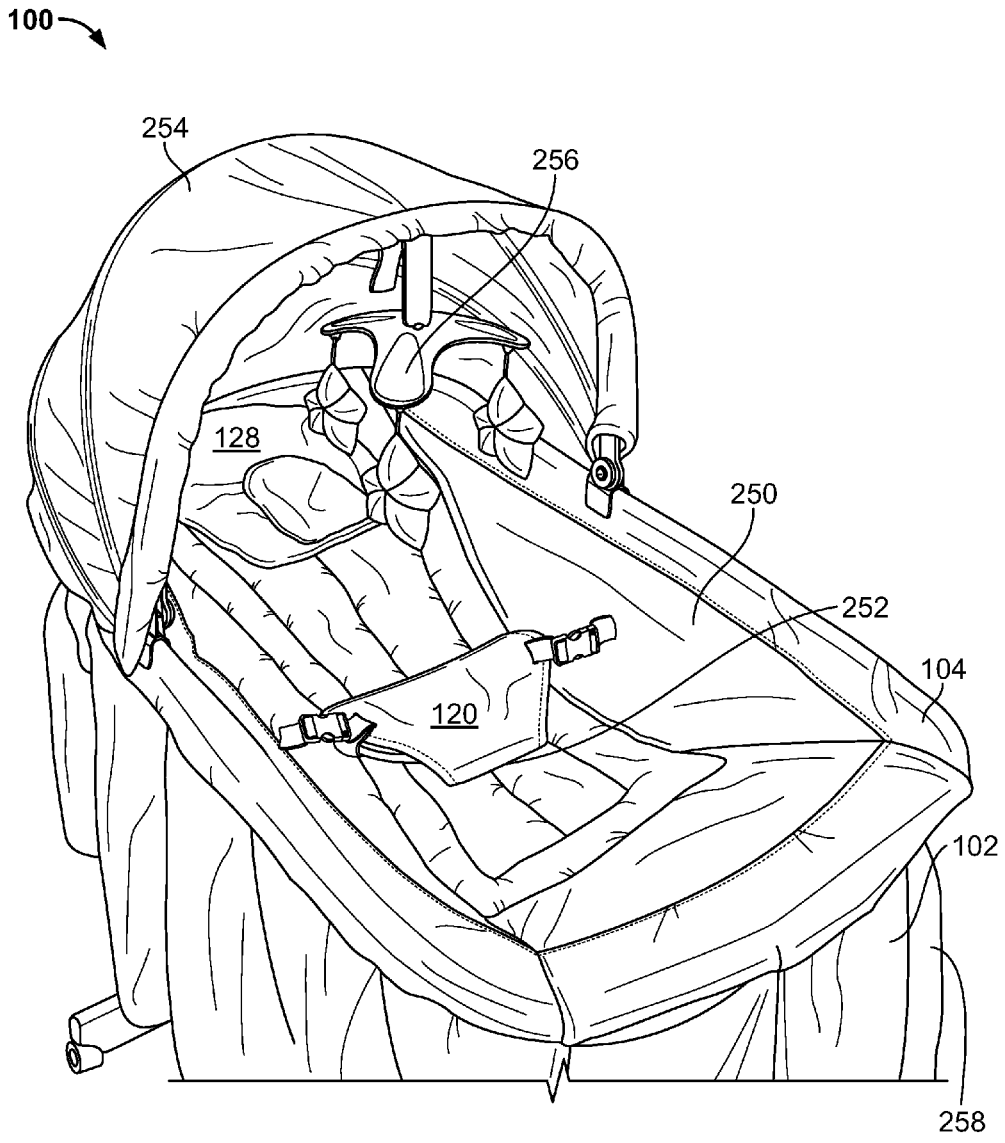
FIG. 14 is a perspective view of another example bassinet seat insert assembly shown installed on an example bassinet.

FIGS. 14-19 show another example seat insert assembly 100. In the interest of brevity, the descriptions of similar structures in the seat insert of FIGS. 14-19 and the above described inserts will not be repeated. Instead, the interested reader is referred to the above discussions for a complete written description of these structures. To facilitate this process, similar structures are identified with similar reference numbers. As shown in FIG. 14, the example bassinet seat insert 104 includes a removable seat cover 250. The seat cover 250 may be removed and, for example, placed in a washer and/or stored. In the illustrated example, the seat cover 250 supplements features of the underlying bassinet seat insert 104 discussed above. For example, the seat cover 250 includes padded surfaces and one or more breathable mesh sides. In addition, the pillow 128 may be coupled to the seat cover 250 in any manner described herein. Furthermore, the harness 120 may also be coupled to the seat cover 250, and/or the seat cover may include a slot 252 through which the harness 120 that is coupled to the underlying bassinet seat insert 104 extends.

Figure 15:
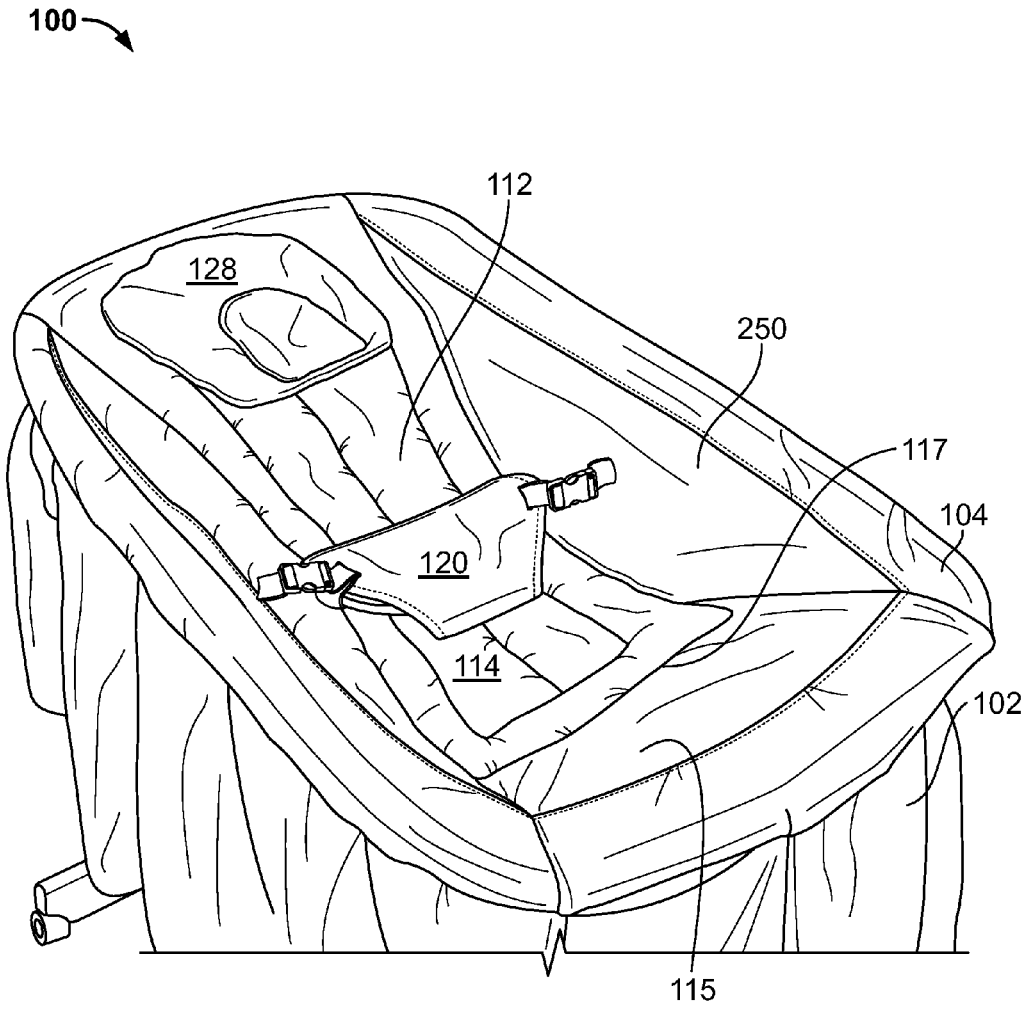
FIG. 15 is a perspective view of the example bassinet seat insert assembly of FIG. 14 with the canopy and mobile removed.

Furthermore, the example of FIG. 1 shows the seat insert with a first base panel 112 and a second base panel 114. As shown in FIGS. 14 and 15, some examples include a third base panel 115. The third base panel 115 has a first end and second end. The first end of the third base panel 115 is coupled to the second end of the second base panel 114 at seam 117. The second end of the second base panel 114 is not coupled to the clip 140, in this example. The second end of the third base panel 115 is coupled to a clip (e.g., the clip 140). Changing the position of the seam 117 with respect to the lengths of the second base panel 114 and the third base panel 115 adjusts the positions of the second base panel 114 and the third base panel 115 and, thus, adjusts the angle of incline of the second base panel 114 and the angle of incline of the third base panel 115. Changing the position of the seam 117 with respect to the lengths of the second base panel 114 and the third base panel 115 also adjusts the position of the first base panel 112 and, thus, adjusts the angle of incline of the first base panel 112 (i.e., the angle of recline). In some examples, the position of the seam 117 and angle of the third base panel 115 renders the second base panel 114 horizontal or substantially horizontal.

In the illustrated example shown in FIG. 14, the seat insert assembly 100 includes a canopy 254 and a mobile 256 coupled around the seat insert 104. In the illustrated example, the mobile 256 is coupled to the canopy 254. The canopy of the example of FIG. 14, is coupled to the underlying basinet 102 via apertures in the seat insert 104. In other examples, the canopy 254 and/or mobile 256 are coupled directly to the seat insert 104. FIG. 15 shows the seat insert assembly 100 with the canopy 254 and mobile 256 removed. There may also be a skirt 258 coupled to the bassinet 102 as shown in FIGS. 14 and 15. Other child care accessories, storage compartments and/or decorative features may additionally or alternatively be incorporated into this structure.

Figure 16:
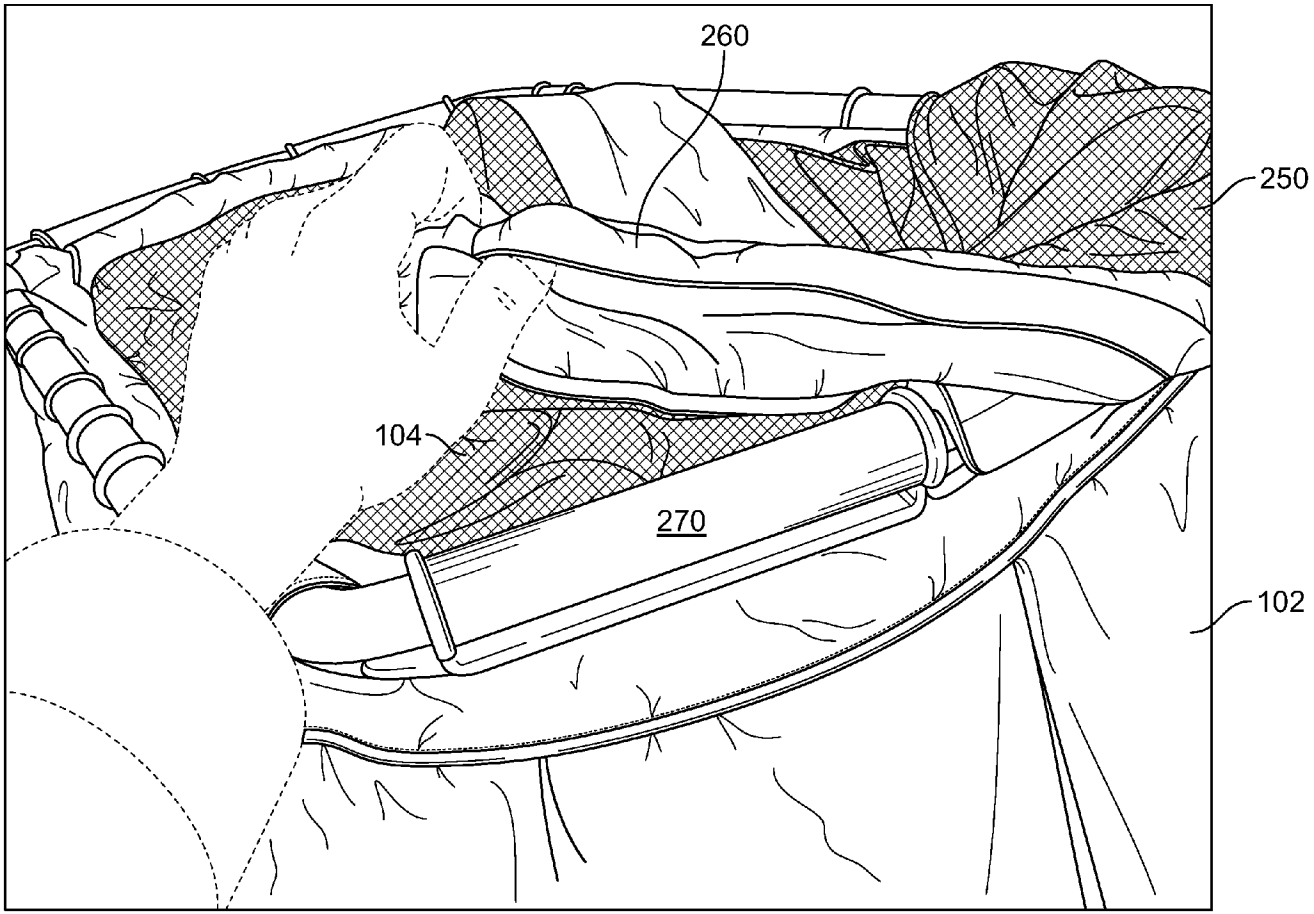
FIG. 16 is an enlarged view of an example bassinet seat insert clip.
Figure 17:
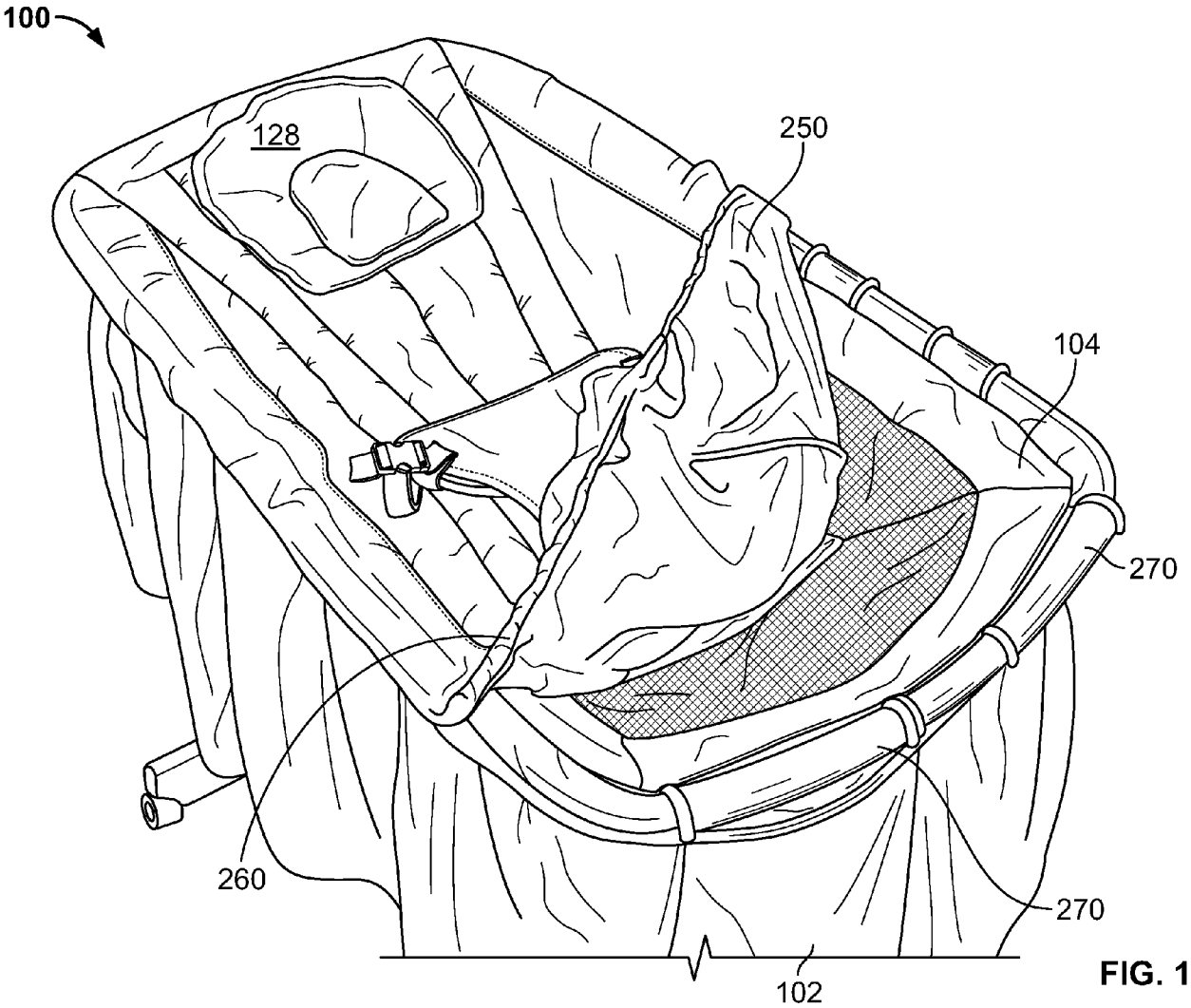
FIG. 17 is a perspective view of the example bassinet seat insert assembly of FIG. 14 with an example seat cover partially removed.

FIGS. 16 and 17 shows a portion of the bassinet seat insert assembly 100 in which a corner of the seat cover 250 is pulled back revealing the underlying seat insert 104. The seat cover 250 of the illustrated example attaches about the seat insert 104 with one or more elastic bands 260 that are sewn into the seat cover 250. The elastic bands 250 shape the fabric of the seat cover 250 into pockets that couple around portions of the seat insert 104. In some examples additional pockets are formed by webbing or sewing the material of the seat cover 250 to form the pocket. In this example, the elastic bands 250 couple around clips 270 that couple the seat insert 104 to the bassinet 102. The elastic bands 260 could be disposed at the corners of the seat cover 250, at two or more sides, around the entire perimeter or otherwise distributed about the periphery of the seat cover 250. Furthermore, while elastic bands are shown in the illustrated example, other coupling mechanisms may be used to couple the seat cover 250 to the seat insert 104 including, for example, clips, hook and loop fasteners, snaps, straps, ties or any other suitable fasteners.

Figure 18:
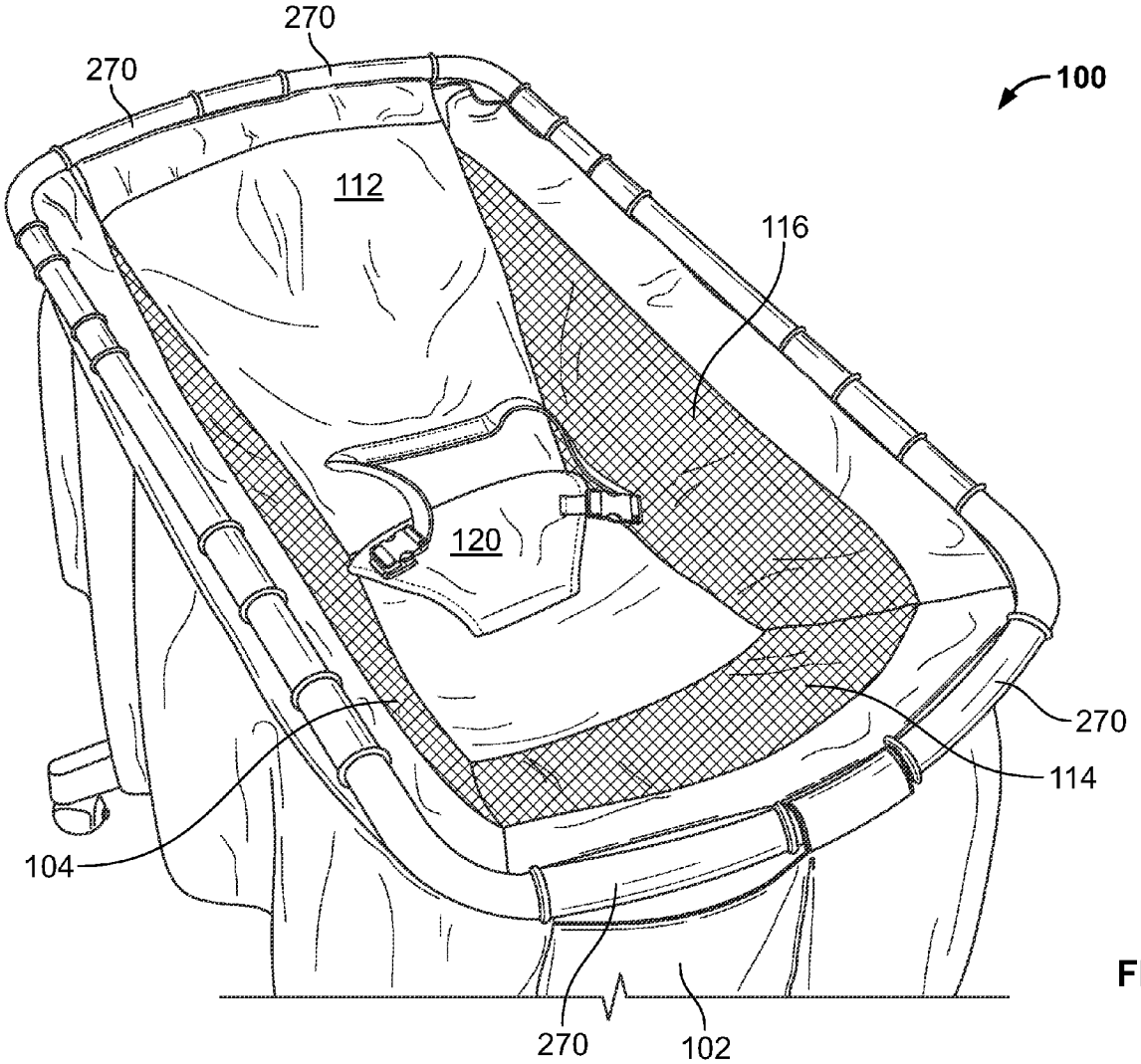
FIG. 18 is a perspective view of the example bassinet seat insert assembly of FIG. 14 with the example seat cover removed.

FIG. 18 shows the seat insert assembly 100 of FIG. 14 with the seat cover 250 removed and the underlying seat insert 104 exposed. As shown in the illustrated example, the seat insert 104 may be coupled to the bassinet 102 via the plurality of clips 270. In this example, there are four clips 270 on the two short ends of the bassinet 102 and additional clips on the long ends. Some of the clips 270 may be integral with other clips 270 (see FIG. 19) where there is a common wall that joins two clips 270. As noted above, other mechanisms for coupling the seat insert 104 to the bassinet 102 (or other structure) may be implemented in addition to or as an alternative to the clips 270.

Figure 19:
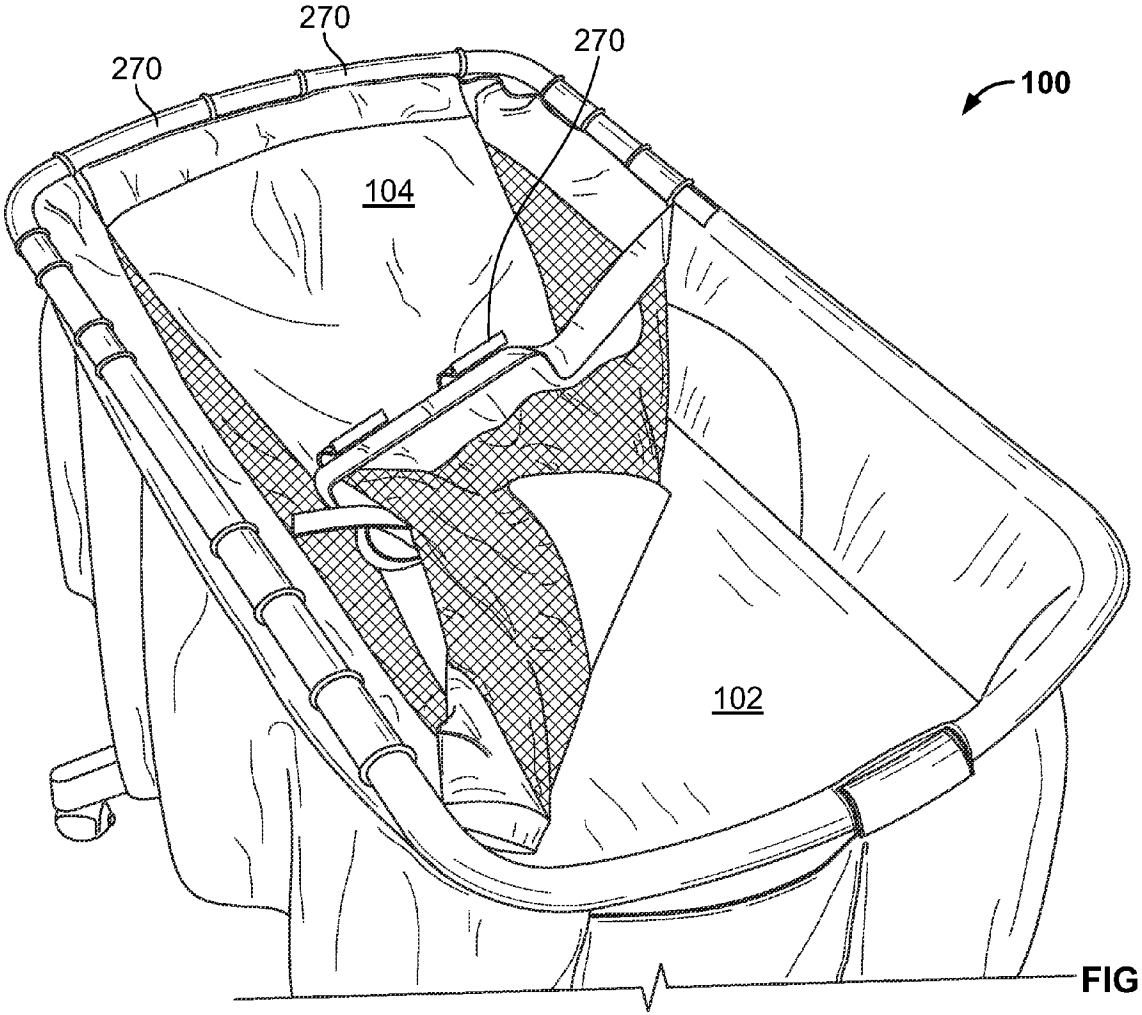
FIG. 19 is a perspective view of the example bassinet seat insert assembly of FIG. 14 partially removed from the example bassinet.

In FIG. 19, the seat insert 104 is shown partially removed. Removing the seat insert 104 reveals the underlying bassinet 102 (or other support structure to which the seat insert 104 is coupled (e.g., a playard)). With the seat insert 104 removed, the bassinet 102 is able to be accessed and used in its normal fashion. Though the examples of FIGS. 14-19 show the seat insert 104 covering substantially the entire upper surface of the bassinet 102, in other examples, the seat insert 104 may only cover a portion of the bassinet 102 and, thus, the seat insert 104 and the bassinet 102 would be usable simultaneously without requiring the seat insert 104 to be removed. In addition, the seat insert 104 may be disposed above the bassinet 102 and adjacent to another child caretaking structure such as, for example, a changing table.

FIG. 20 shows an alternative example child caretaking structure in which a changing table 310 is coupled to a bassinet 102. The changing table includes a frame 312 and a plurality of clips 314. In the example of FIG. 20, the clips 314 are coupled to the frame of the bassinet 102 to couple the changing table 310 to the bassinet 102 above the top rail of the bassinet 102. The clips 314 extend in a vertical orientation and have a cross-section corresponding to an inverted Y. The lower portion of the inverted Y is defined by two resilient plates that are positioned and sized to frictionally clamp onto the top rail of the bassinet 102. The top portion of the inverted Y is coupled to the changing table. Thus, the rail of the changing table and the top part of the bassinet 102 lie in a same vertical plane. The example seat insert 104 may also be coupled to the bassinet 102 or a playard (e.g., the playard 400 of FIG. 7) via the clips 314.

An example method of manufacturing an example seat insert such as, for example, the example seat insert 104, described above (FIG. 1), includes providing fasteners (e.g., clips 132, 140) to suspend the example seat insert from an example bassinet (e.g., bassinet 102) or an example playard (e.g., playard 400 of FIG. 7). The example method also includes providing a first panel (e.g., base panel 112) and a second panel (e.g., base panel 114). The first panel has a first length, a first end and a second end. The second panel having a second length, a first end and a second end. The first panel and the second panel are coupled to the fasteners. The first length is longer than the second length so that the first panel is to be positioned at a first incline, and the second panel is to be positioned at a second incline. In this example, the second incline is different than the first incline when the seat insert is coupled to the basinet or the playard to cause a child occupant to assume a semi-upright position.

An example method of manufacturing an example seat insert such as, for example, the seat insert 104 described in FIGS. 14 and 15 includes providing a third panel (e.g., the seat pan or second base panel 114 of FIG. 15) having a third length, a first end and a second end. The third panel is coupled between the first panel (e.g., the seat back or first base panel 112 of FIG. 15) and the second panel (e.g., third base panel 115 of FIG. 15). The length of the second panel is longer than the third length so that the third panel is positioned at a third incline different than the first incline of the first panel and the second incline of the second panel when the seat insert is coupled to the basinet or the playard. The third incline may be substantially zero degrees (i.e., substantially horizontal).

The example method of manufacture additionally or alternatively includes adjustably coupling the first panel and the second panel with respect to each other. Such arrangement facilitates changing the length of first panel or the length of the second panel. Changing the length(s) of the panel(s) changes a degree of the first incline or a degree of the second incline.

The example method of manufacture described herein additionally or alternatively includes coupling a first side panel (e.g., side panel 116) to the first panel and the second panel. The example method also includes coupling a second side panel (e.g., side panel 118) to the first panel and the second panel. The side panels are coupled to the seat insert so the first side panel and the second side panel form a v-shaped profile.

From the foregoing, persons of ordinary skill in the art will appreciate that bassinets with seat insert(s) and methods of assembling and manufacture the same have been disclosed. Furthermore, the descriptions of each example described herein are not meant to be limiting to the specific example. Any feature(s) of any example(s) may be substituted for and/or combined with other feature(s) of other example(s). In addition, although the disclosure has focused on a bassinet, the teachings of this disclosure are applicable to other child care products such as bouncers, swing seats, cribs, high chairs, portable playards, portable bassinets for support within playards, rocking bassinets, changing tables, etc.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A seat insert comprising:

a fastener to removably couple the seat insert to a child caretaking structure;

a first base panel having a first length, a first end and a second end; and a second base panel having a second length, a first end and a second end, the second end of the first base panel being coupled to the first end of the second base panel, wherein the first length is longer than the second length so that the first base panel is positioned at a first incline and the second base panel is positioned at a second incline different than the first incline to position a first child support surface of the first base panel at an obtuse angle relative to a second child support surface of the second base panel to cause a child occupant of the seat insert to assume a semi-upright position.

2. A seat insert as defined in claim 1, wherein the fastener is a clip.

3. A seat insert as defined in claim 1, wherein the fastener is disposed within a fabric cover.

4. A seat insert as defined in claim 1, wherein the fastener couples the seat insert above a top frame of the child caretaking structure.

5. A seat insert as defined in claim 1, wherein the fastener is directly coupled to at least one of the first base panel or the second base panel.

6. A seat insert as defined in claim 1, wherein the first base panel and the second base panel are integrally formed.

7. A seat insert as defined in claim 1, wherein the first base panel and the second base panel are directly coupled.

8. A seat insert as defined in claim 1, wherein the first base panel and the second base panel are adjustable with respect to each other to change at least one of the first length or the second length to change at least one of a degree of the first incline or a degree of the second incline.

9. A seat insert as defined in claim 1, wherein the effective length of the first base panel is adjustable to change the degree of the first incline.

10. A seat insert as defined in claim 1, wherein the fastener comprises a first fastener and a second fastener, the first end of the first base panel is coupled to the first fastener and the second end of the second base panel is coupled to the second fastener.

11. A seat insert as defined in claim 1, wherein the second base panel includes one or more apertures to accommodate a child's legs.

12. A seat insert as defined in claim 1 further comprising a harness coupled to one or more of the first base panel or the second base panel.

13. A seat insert as defined in claim 1 further comprising:

a first side panel coupled to the first base panel and the second base panel, and a second side panel coupled to the first base panel and the second base panel.

14. A seat insert as defined in claim 13, wherein the first side panel and the second side panel are disposed at angles with respect to each other to form a v-shaped profile.

15. A seat insert as defined in claim 1 further comprising an adjustable pillow to be coupled to the first base panel in a first position and a second position.

16. A seat insert as defined in claim 15, wherein the pillow is couplable to the first base panel via a loop and hook fastener.

17. A seat insert as defined in claim 1 further comprising a strap to traverse the entire width of the seat insert.

18. A seat insert as defined in claim 1 further comprising a frame element coupled to one or more of the first base panel, the second base panel, a first side panel or a second side panel.

19. A seat insert as defined in claim 1, wherein at least one of the first base panel, the second base panel, a first side panel or a second side panel comprises a flexible material to stretch the seat insert across different sized child caretaking structures.

20. A seat insert as defined in claim 1 further comprising a removable seat cover coupled to the seat insert.

21. A seat insert as defined in claim 1 further comprising a lock to releasably lock the seat insert to the child caretaking structure.

22. A seat insert as defined in claim 1, wherein the seat insert is disposed over only a portion of the child caretaking structure.

23. A seat insert as defined in claim 1, wherein the fastener includes a slot through which a portion of at least one of the first base panel or the second base panel is inserted to couple the seat insert to the fastener.

24. A seat insert as defined in claim 1 further comprising a third panel having a third length, a first end and a second end, the second end of the second base panel being coupled to the first end of the third base panel, the third length being longer than the second length so that the third base panel is positioned at a third incline different than the second incline.

25. A method of manufacturing a seat insert, the method comprising:

providing fasteners to suspend the seat insert from a child caretaking structure;

providing a first panel and a second panel, the first panel having a first length, a first end and a second end, the second panel having a second length, a first end and a second end; and coupling the first panel and the second panel to the fasteners, wherein the first length is longer than the second length so that the first panel is to be positioned at a first incline and the second panel is to be positioned at a second incline different than the first incline when the seat insert is coupled to the child caretaking structure to provide an obtusely angled child resting surface to cause a child occupant of the seat insert to assume a semi-upright position.

26. A method defined in claim 25, further comprising adjustably coupling the first panel and the second panel with respect to each other to facilitate changing at least one of the first length or the second length to change at least one of a degree of the first incline or a degree of the second incline.

27. A method as defined in claim 25 further comprising:

coupling a first side panel to the first panel and the second panel; and coupling a second side panel to the first panel and the second panel such that the first side panel and the second side panel form a v-shaped profile.

28. A method as defined in claim 25 further comprising:

providing a third panel having a third length, a first end and a second end; and coupling the third panel between the first panel and the second panel, wherein the second length is longer than the third length so that the third panel is to be positioned at a third incline different than the first incline and the second incline when the seat insert is coupled to the basinet or the playard.

29. A method as defined in claim 28, wherein the third incline is substantially zero degrees.

* * * * *